US007307918B2

(12) United States Patent
Liu

(10) Patent No.: US 7,307,918 B2
(45) Date of Patent: Dec. 11, 2007

(54) DRIVING MECHANISM FOR RADIO-CONTROLLED CLOCKS

(75) Inventor: Tsai-Te Liu, Taoyuan (TW)

(73) Assignee: Ele Gancy Tleleancy Co., Ltd, Taoyuan (TW)

( * ) Notice: Subject to any disclaimer, the term of this patent is extended or adjusted under 35 U.S.C. 154(b) by 413 days.

(21) Appl. No.: 11/024,139

(22) Filed: Dec. 27, 2004

(65) Prior Publication Data

US 2006/0140062 A1 Jun. 29, 2006

(51) Int. Cl.
*G04C 11/02* (2006.01)

(52) U.S. Cl. ..... 368/47

(58) Field of Classification Search ..... 368/47, 368/157, 160, 221, 327; 310/83, 75 D, 156.22, 310/75 R See application file for complete search history.

(56) References Cited

U.S. PATENT DOCUMENTS

| | | | | |
|---|---|---|---|---|
| 2,893,257 | A * | 7/1959 | Schulte | 74/409 |
| 3,872,334 | A * | 3/1975 | Loubier | 310/43 |
| 3,967,790 | A * | 7/1976 | Hess | 242/415.1 |
| 6,114,771 | A * | 9/2000 | Takagi et al. | 290/38 R |
| 6,744,156 | B2 * | 6/2004 | Doi | 310/49 R |
| 2006/0039815 | A1 * | 2/2006 | Chertok et al. | 418/61.3 |

* cited by examiner

*Primary Examiner*—Vit Miska
*Assistant Examiner*—Jeanne-Marguerite Goodwin

(57) ABSTRACT

A driving mechanism for radio-controlled clocks includes a gear having a pre-decided point and a permanent magnet including an N pole and an S pole is secured to the gear. An angle clamped between a line connecting the pre-decided point and a center of the gear and another line connecting the N pole and S pole is fixed.

10 Claims, 7 Drawing Sheets

DRIVING MECHANISM FOR RADIO-CONTROLLED CLOCKS

FIELD OF THE INVENTION

The present invention relates to a radio-controlled clock, and more particularly, to a driving mechanism for a radio-controlled clock.

BACKGROUND OF THE INVENTION

A conventional radio-controlled clock generally includes a micro antenna, receiving chips, microprocessors, and driving mechanism. The standard time data received by the chips from the micro antenna is regulated and sent to the microprocessor which checks the data of the clock according to the standard time date. The driving mechanism is responsible for the movement of the second, minute and hour arms. When checking with the standard time data, the second arm, minute arm and hour arm are initialized to zero position first and then adjusted to the correct positions. The initialization is made by using photoelectric sensors to precisely position the arms. Some radio-controlled clocks use two motors cooperated with two individual reduction gear sets to drive the gears in the clocks. Due to the fact that the gears are engaged with each other, the precise position for the driving gear is important during assembly stage.

The radio-controlled clocks include a gear and a permanent magnet that is activated to rotate when electric current powers the coil of motor. The magnetic and the gear are connected with each other so that the gear is co-rotated with the magnet. An angle between a line between N-S poles of the magnet and a pre-decided point on the magnet has to be fixed. If the angle is not fixed, when the power is cut, the point on the gear has to be moved to be aligned with the line of N-S poles and this affects the position of the second arm. The assemblers have to spend a lot of time to check and re-adjust the position of the second arm.

Therefore, it is desired to have a driving mechanism for radio-controlled clocks wherein the gear and the permanent magnet are secured with each other so that the angle is fixed.

SUMMARY OF THE INVENTION

In accordance with an aspect of the present invention, there is provided a driving mechanism for radio-controlled clocks and the mechanism comprises a gear having a pre-decided point and a permanent magnet including an N pole and an S pole is secure to the gear. An angle clamped between a line connecting the pre-decided point and a center of the gear and another line connecting the N pole and S pole is fixed.

The present invention will become more obvious from the following description when taken in connection with the accompanying drawings, which show, for purposes of illustration only, a preferred embodiment in accordance with the present invention.

DETAILED DESCRIPTION OF THE PREFERRED EMBODIMENT

Figure 1:
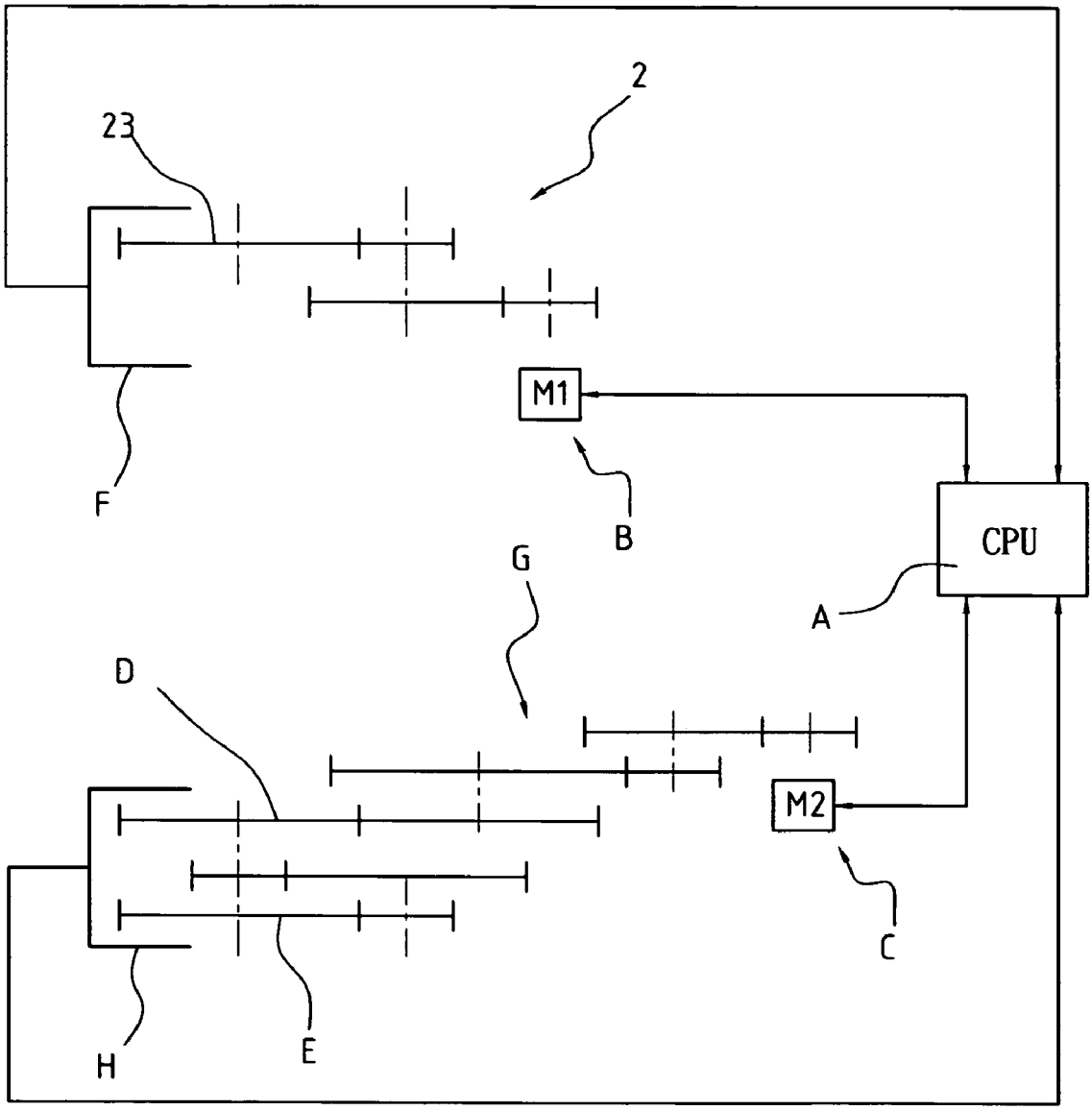
FIG. 1 shows the structure of a radio-controlled clock in accordance with the present invention.

Referring to the drawings and in particular FIG. 1 which shows a radio-controlled clock having two driving motors, including a first step motor "B" which drives a second arm wheel 23 via a reduction gear set 2 and a second step motor "C" which drives a minute arm wheel "D" and an hour arm wheel "E" via a reduction gear set "G". A photoelectric sensor "F" is located beside the second arm wheel 23 and another photoelectric sensor "H" is located beside the minute arm wheel "D" and the hour arm wheel "E". These photoelectric sensors "F" and "H" check holes defined through the second arm wheel 23, the minute arm wheel "D" and the hour arm wheel "E" to initialize them to zero. All the parts mentioned above are installed in a core of the clock and the shafts of the second arm wheel, the minute arm wheel and the hour arm wheel extend out from the core so as to respectively connect the arms.

Figure 2:
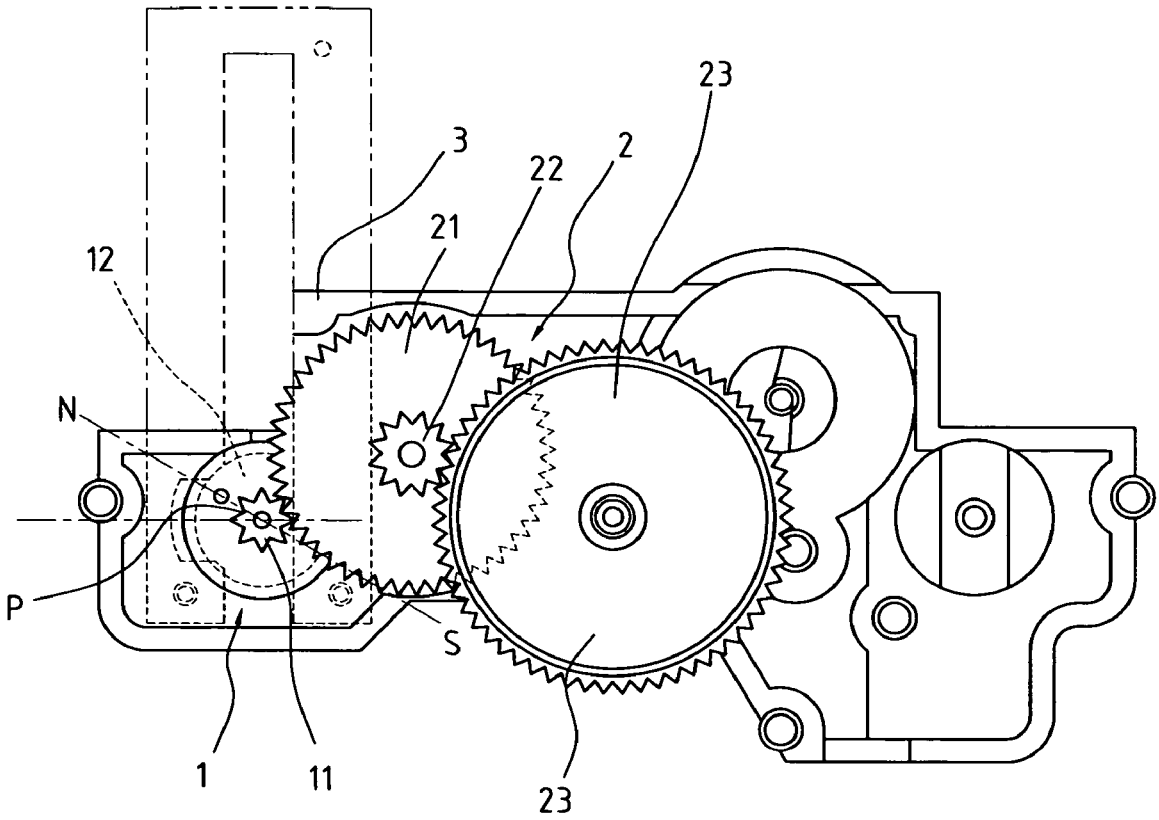
FIG. 2 shows that when the driving mechanism of the present invention is installed to the core of the clock, an angle clamped between a line connecting the pre-decided point and a center of the gear and another line connecting the N pole and S pole is fixed.

As shown in FIG. 2, the driving mechanism 1 is mounted to a shaft (not shown) on a panel 3 and the permanent magnet 12 faces downward and the gear 11 faces upward. The idle wheel 21 of the second arm reduction gear set 2 is engaged with the gear 11. The second arm wheel 23 is engaged with the small gear 22 on the idle wheel 21 of the second arm. An angle clamped between a line connecting the point "P" on the gear 11 and a center of the gear 11 and another line connecting the N pole and S pole of the permanent magnet is calculated according to several factors such as the factors of stator, module numbers of the gears, and the magnet factor. The angle can be in a range between 0 to 180 degrees. In this embodiment, the point "P" is located on the dedendum circle of the gear 11 and close to the line connecting the N pole and S pole of the permanent magnet, and the angle is set to be 0 degree. In other words, the two lines are coincident with each other. The initial position of the gear is shown in FIG. 2 and advantageous for installing the idle wheel 21 and the second arm wheel 23. The point "P" is located at a lowest position between the two adjacent teeth of the gear.

Figure 3A:
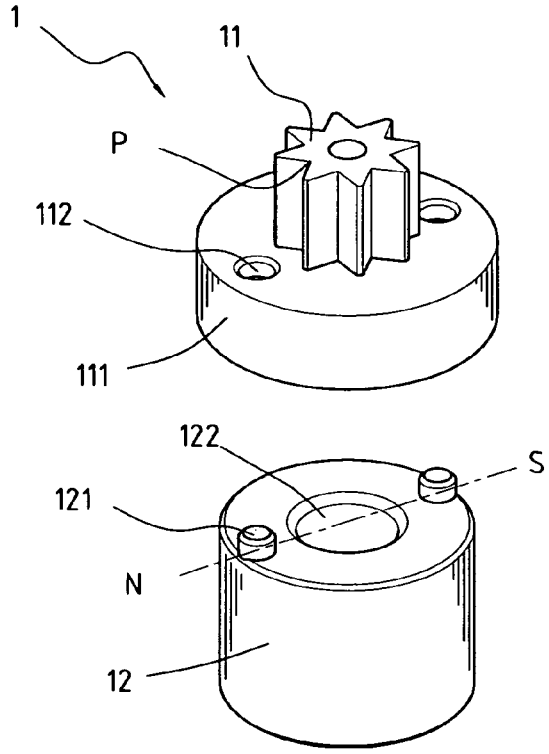
FIGS. 3A and 3B show a first embodiment of the permanent magnet and the gear of the driving mechanism of present invention.
Figure 3B:
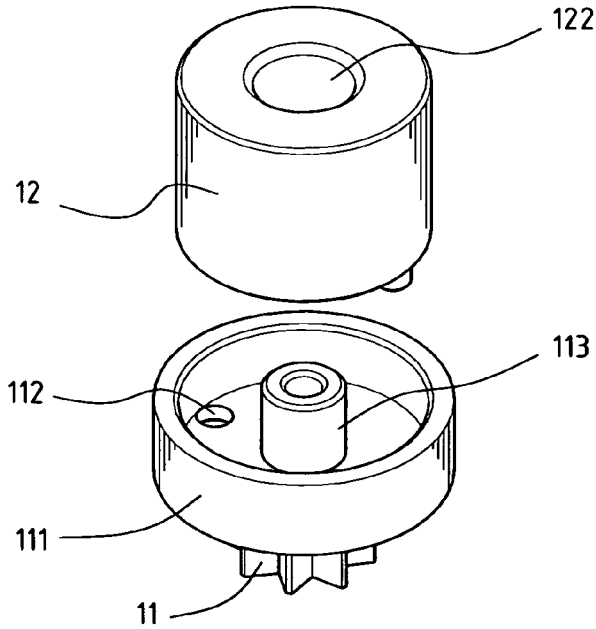

FIGS. 3A and 3B show a first embodiment of the permanent magnet 12 and the gear 11 of the driving mechanism of present invention, wherein the permanent magnet 12 includes a central hole 122 and a plurality of protrusions 121 and the gear 11 is connected to a base member 111 which includes a rod 113 opposite to the gear 11 and a plurality of apertures 112. The base member 111 is mounted onto the permanent magnet 12 and the rod 113 is engaged with the central hole 122 and the protrusions 121 are engaged with the apertures 112. By this way, the gear 11 is secured to the permanent magnet 12. A line connecting two of the protrusions 121 is coincident with the line connecting the N pole and the S pole, and a line connecting two of the apertures 112 passes through the pre-decided point "P".

Figure 4A:
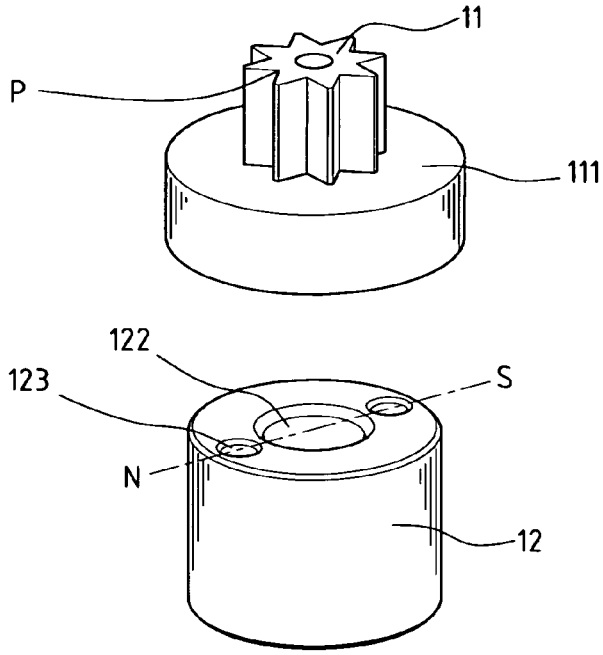
FIGS. 4A and 4B show a second embodiment of the permanent magnet and the gear of the driving mechanism of present invention.
Figure 4B:
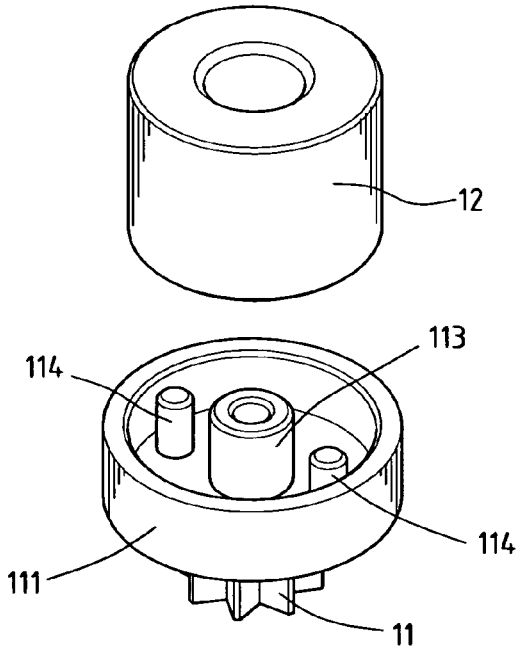

FIGS. 4A and 4B show a second embodiment of the permanent magnet 12 and the gear 11 of the driving mechanism of present invention, wherein the permanent magnet 12 includes a central hole 122 and a plurality of apertures 123. The gear 11 is connected to a base member 111 which includes a rod 113 and a plurality of protrusions 114 which are engaged with the apertures 123 and the rod 113 is engaged with the central hole 122. A line connecting two of the apertures 123 is coincident with the line connecting the N pole and the S pole. A line connecting two of the protrusions 114 passes through the pre-decided point "P".

Figure 5A:
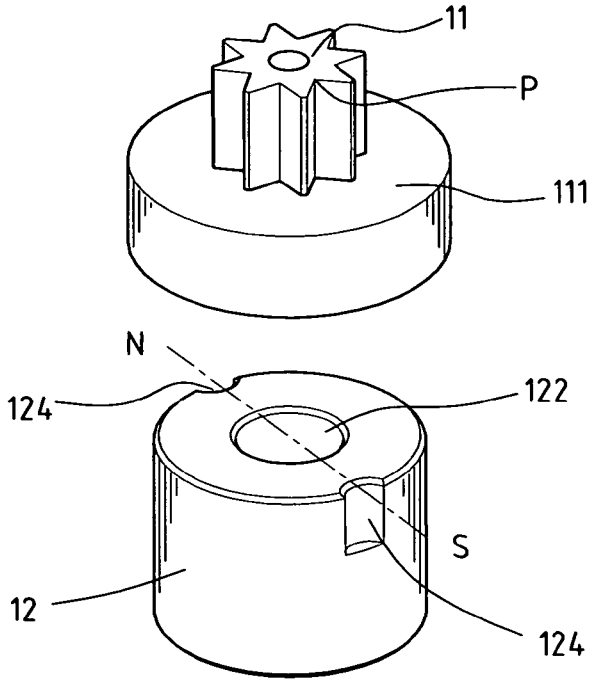
FIGS. 5A and 5B show a third embodiment of the permanent magnet and the gear of the driving mechanism of present invention.
Figure 5B:
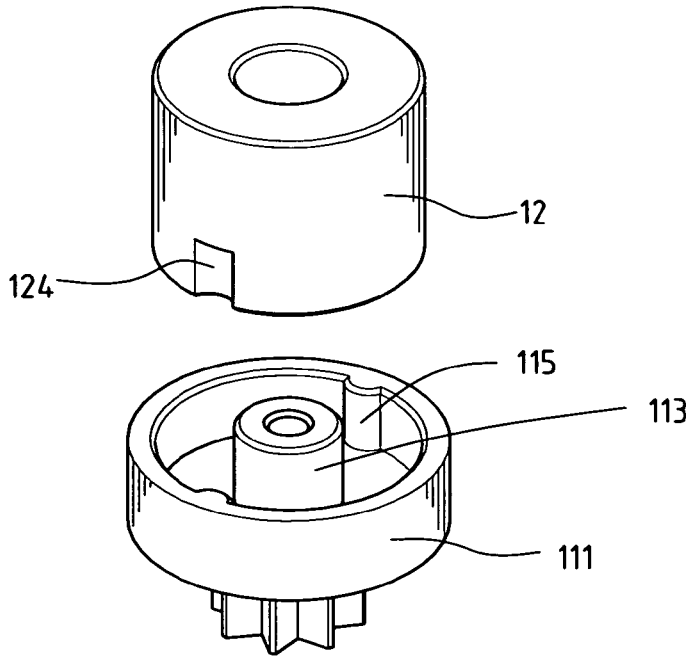

FIGS. 5A and 5B show a third embodiment of the permanent magnet 12 and the gear 11 of the driving mechanism of present invention, wherein the permanent magnet 12 includes a central hole 122 and a plurality of recesses 124 are defined in an outer periphery of the permanent magnet 12. The gear 11 is connected to a base member 111 that includes a rod 113 and a plurality of ridges 115 extend from an inner periphery of the base member 111. The rod 113 is engaged with the central hole 122 and the ridges 115 are engaged with the recesses 124. A line connecting two of the recesses 124 is coincident with the line connecting the N pole and the S pole. A line connecting two of the ridges 115 passes through the pre-decided point "P".

Figure 6:
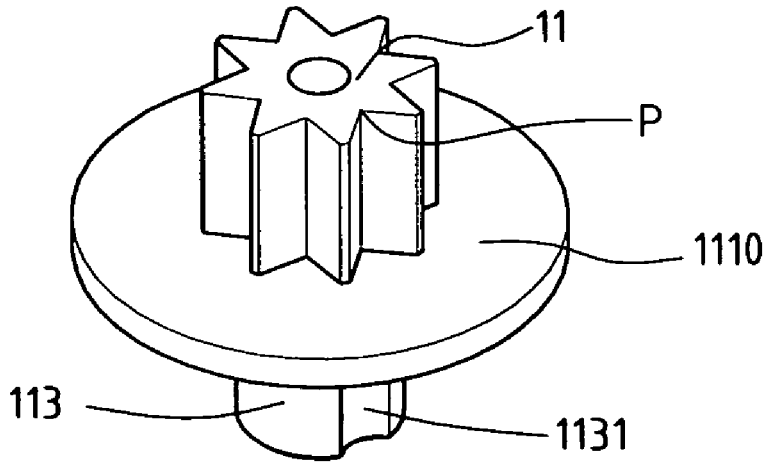
FIG. 6 shows a fourth embodiment of the permanent magnet and the gear of the driving mechanism of present invention.
Figure 6:
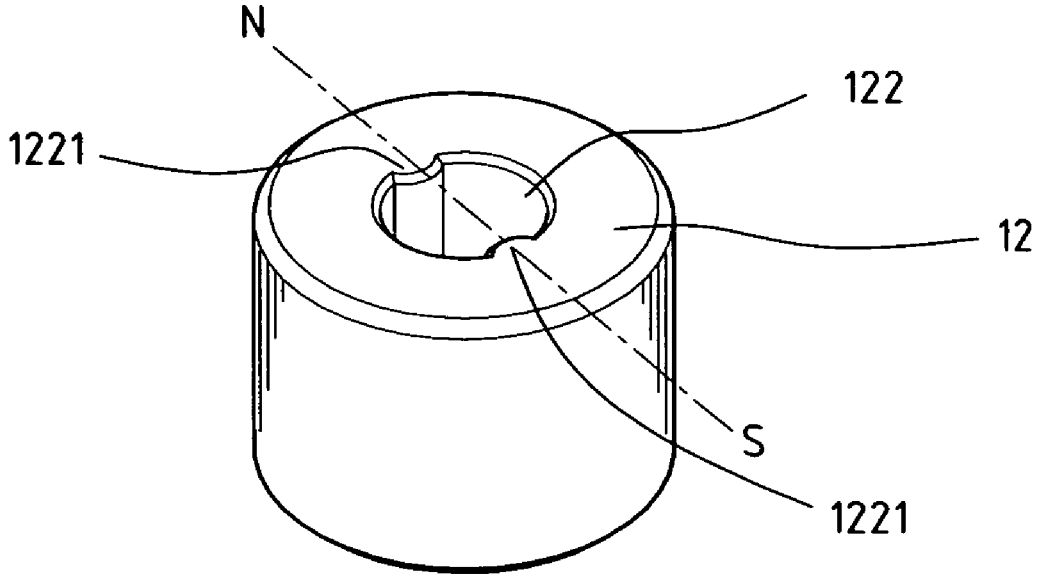

FIG. 6 shows a fourth embodiment of the permanent magnet 12 and the gear 11 of the driving mechanism of present invention, wherein the permanent magnet 12 includes a central hole 122 and a plurality of bosses 1221 extend from an inner periphery of the central hole 122. The gear 11 is connected to a board 1110 that includes a rod 113 and a plurality of recesses 1131 are defined in an outer periphery of the rod 113. The rod 113 is engaged with the central hole 122 and the bosses 1221 are engaged with the recesses 1131. A line connecting two of the bosses 1221 is coincident with the line connecting the N pole and the S pole. A line connecting two of the recesses 1131 passes through the pre-decided point "P".

Figure 7:
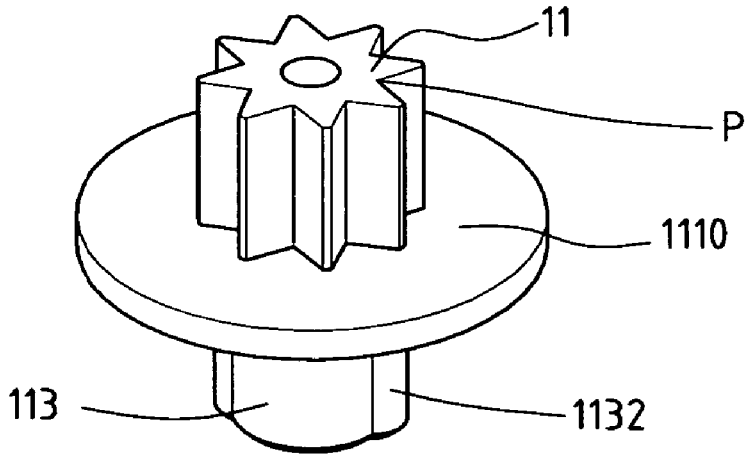
FIG. 7 shows a fifth embodiment of the permanent magnet and the gear of the driving mechanism of present invention.
Figure 7:
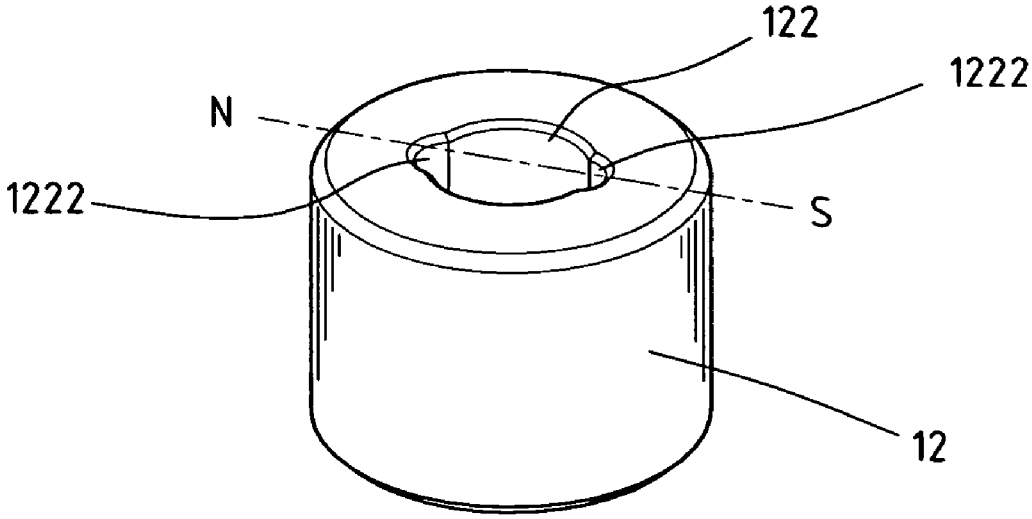

FIG. 7 shows a fifth embodiment of the permanent magnet 12 and the gear 11 of the driving mechanism of present invention, wherein the permanent magnet 12 includes a central hole 122 and a plurality of recesses 1222 are defined in an inner periphery of the central hole 122. The gear 11 is connected to a board 1110 that includes a rod 113 and a plurality of ridges 1132 extend from an outer periphery of the rod 113. The rod 113 is engaged with the central hole 122 and the ridges 1132 are engaged with the recesses 1222. A line connecting two of the 1222 is coincident with the line connecting the N pole and the S pole. A line connecting two of the ridges 1132 passes through the pre-decided point "P".

While we have shown and described the embodiment in accordance with the present invention, it should be clear to those skilled in the art that further embodiments may be made without departing from the scope of the present invention.

What is claimed is:

1. A driving mechanism (1) for radio-controlled clocks, comprising:

a gear (11) having a pre-decided point "P"; and a permanent magnet (12) including an N pole and an S pole, the gear (11) being secured to the permanent magnet (12) so that an angle clamped between a line connecting the point "P" and a center of the gear (11) and another line connecting the N pole and S pole is fixed;

wherein the permanent magnet (12) includes a central hole (122) and a plurality of protrusions (121) and the gear (11) is connected to a base member (111) which includes a rod (113) and a plurality of apertures (112), the rod (113) is engaged with the central hole (122) and the protrusions (121) are engaged with the apertures (112).

2. The mechanism as claimed in claim 1, wherein a line connecting two of the protrusions (121) is coincident with the line connecting the N pole and the S pole, and a line connecting two of the apertures (112) passes through the pre-decided point "P".

3. A driving mechanism (1) for radio-controlled clocks, comprising:

a gear (11) having a pre-decided point "P"; and a permanent magnet (12) including an N pole and an S pole, the gear (11) being secured to the permanent magnet (12) so that an angle clamped between a line connecting the point "P" and a center of the gear (11) and another line connecting the N pole and S pole is fixed;

wherein the permanent magnet (12) includes a central hole (122) and a plurality of apertures (123) and the gear (11) is connected to a base member (111) which includes a rod (113) and a plurality of protrusions (114) which are engaged with the apertures (123) and the rod (113) is engaged with the central hole (122).

4. The mechanism as claimed in claim 3, wherein a line connecting two of the apertures (123) is coincident with the line connecting the N pole and the S pole, and a line connecting two of the protrusions (114) passes through the pre-decided point "P".

5. A driving mechanism (1) for radio-controlled clocks, comprising:

a gear (11) having a pre-decided point "P"; and a permanent magnet (12) including an N pole and an S pole, the gear (11) being secured to the permanent magnet (12) so that an angle clamped between a line connecting the point "P" and a center of the gear (11) and another line connecting the N pole and S pole is fixed;

wherein the permanent magnet (12) includes a central hole (122) and a plurality of recesses (124) are defined in an outer periphery of the permanent magnet (12), the gear (11) is connected to a base member (111) which includes a rod (113) and a plurality of ridges (115) extend from an inner periphery of the base member (111), the rod (113) is engaged with the central hole (122) and the ridges (115) are engaged with the recesses (124).

6. The mechanism as claimed in claim 5, wherein a line connecting two of the recesses (124) is coincident with the line connecting the N pole and the S pole, and a line connecting two of the ridges (115) passes through the pre-decided point "P".

7. A driving mechanism (1) for radio-controlled clocks, comprising:

a gear (11) having a pre-decided point "P"; and a permanent magnet (12) including an N pole and an S pole, the gear (11) being secured to the permanent magnet (12) so that an angle clamped between a line connecting the point "P" and a center of the gear (11) and another line connecting the N pole and S pole is fixed;

wherein the permanent magnet (12) includes a central hole (122) and a plurality of bosses (1221) extend from an inner periphery of the central hole (122), the gear (11) is connected to a board (1110) which includes a rod (113) and a plurality of recesses (1131) are defined in an outer periphery of the rod (113), the rod (113) is engaged with the central hole (122) and the bosses (1221) are engaged with the recesses (1131).

8. The mechanism as claimed in claim 7, wherein a line connecting two of the bosses (1221) is coincident with the line connecting the N pole and the S pole, and a line connecting two of the recesses (1131) passes through the pre-decided point "P".

9. A driving mechanism (1) for radio-controlled clocks, comprising:

a gear (11) having a pre-decided point "P"; and a permanent magnet (12) including an N pole and an S pole, the gear (11) being secured to the permanent magnet (12) so that an angle clamped between a line connecting the point "P" and a center of the gear (11) and another line connecting the N pole and S pole is fixed;

wherein the permanent magnet (12) includes a central hole (122) and a plurality of recesses (1222) are defined in an inner periphery of the central hole (122), the gear (11) is connected to a board (1110) which includes a rod (113) and a plurality of ridges (1132) extend from an outer periphery of the rod (113), the rod (113) is engaged with the central hole (122) and the ridges (1132) are engaged with the recesses (1222).

10. The mechanism as claimed in claim 9, wherein a line connecting two of the (1222) is coincident with the line connecting the N pole and the S pole, and a line connecting two of the ridges (1132) passes through the pre-decided point "P".

* * * * *